United States Patent [19]

Nibler

[11] 4,451,943

[45] Jun. 5, 1984

[54] WETTING DEVICE FOR TOILET PAPER

[76] Inventor: Allen R. Nibler, R.R. 2, Box 280, Walla Walla, Wash. 99362

[21] Appl. No.: 470,136

[22] Filed: Feb. 28, 1983

[51] Int. Cl.[3] ..... A47K 17/00

[52] U.S. Cl. ..... 4/661; 4/300.1; 4/222; 134/6; 239/274

[58] Field of Search ..... 4/661, 300.1, 222; 222/174, 180; 15/104.93; 424/28; 401/125; 239/274; 134/6

[56] References Cited

U.S. PATENT DOCUMENTS

| | | | |
|---|---|---|---|
| 2,746,798 | 5/1956 | Wardell, Jr. | 4/222 X |
| 3,002,197 | 10/1961 | Tillman | 222/180 X |
| 3,068,492 | 12/1962 | Price | 222/180 UX |
| 3,083,374 | 4/1963 | Watlington | 4/300.1 X |
| 3,088,125 | 5/1963 | Southwood | 222/180 X |
| 3,143,745 | 8/1964 | Price | 4/222 |
| 3,776,773 | 12/1973 | Taft | 4/300.1 |
| 4,056,228 | 11/1977 | Rosenkrantz | 239/274 |

*Primary Examiner*—Henry K. Artis

*Attorney, Agent, or Firm*—Keith S. Bergman

[57] ABSTRACT

A water disperser, carried by the water closet of a flush toilet, to dispense water to wet toilet paper before use. Water is provided by the water closet supply system and the unused portion is wasted to upon associated toilet bowl. The device disperses water on manual activation through a secondary reservoir in relatively low volume flow, in a linear pattern of some length and for a pre-determined period of time.

4 Claims, 8 Drawing Figures

WETTING DEVICE FOR TOILET PAPER

RELATED APPLICATIONS

There are no applications related hereto heretofore filed in this or any foreign country.

FIELD OF INVENTION

My invention relates generally to human toiletry devices and more particularly to a device associated with a flush toilet to wet toilet paper.

DESCRIPTION OF PRIOR ART

Though the use of water for washing purposes in the toilet has been commonplace in Europe, primarily in the form of a bidet, the practice has not become well established in the United States though it is gradually making inroads toward acceptance. The use of water, wetted wipers or similar cleansing devices after toilet use has obvious substantial physiological and aesthetic benefits and because of this the practice is becoming more established. The use of the traditional bidet as such, however, has not been well accepted in this country largely because a separate fixture is required which is not readily accomodated in traditional bathroom structures and its use adds substantially to the cost of a bathroom.

The instant invention seeks to provide a device to wet toilet paper before use to provide substantially the same benefits as a bidet in cleansing involved body tissues after toilet functions. The device is relatively small and inexpensive and may be used as an adjunct to the water closet of the common present day flush toilet without any substantial modification.

Heretofore various devices for supplying fluid to toilet tissue prior to use have become known per se. In the ordinary household type flush toilet, a static reservoir or water closet holds a substantial volume of water to be released upon manual activation to flush an associated toilet bowl. This reservoir normally is supplied by a pressurized water system but maintained at atmospheric pressure by some appropriate valving means between the reservoir and water supply. One type of prior toilet paper wetting device has used the unpressurized supply of water of such a toilet system to wet toilet paper in one fashion or another. In distinguishment, my invention supplies water from the pressurized water supply system through a separate valving system to a secondary self-contained reservoir from which it is immediately released so that it is not maintained for substantial periods of time during non-use in a container where it may be contaminated. Other known toilet paper wetting devices have provided a wetting of paper by disbursement of water from a secondary reservoir that is contained or enclosed but one which must be manually filled and is not connected to the toilet's water supply system, either on the pressurized or unpressurized side. This type of wetting device normally is more difficult to operate than the instant device as some secondary valving or spray means must be provided for water dispersement and it is less convenient as it does not have an automatic continuous water supply.

Another group of toilet paper wetting devices have provided humidity for toilet paper prior to use but have not directly applied water to it to wet it to any substantial degree. This type of device generally does not provide sufficient water to the toilet paper to allow efficient tissue washing operations but rather it is intended more to soften the harshness or abrasion potentiality of paper when applied in a rubbing fashion to normally sensitive human membranes.

My invention seeks to alleviate the various problems associated with devices of the prior art and is distinguished from that prior art in so doing not in any one feature or function per se, but rather in the particular and unique combination of all structural features to accomplish the function set forth.

SUMMARY OF INVENTION

My invention provides generally a toilet paper wetting device, carried on the outer surface of the water closet of a flush toilet, with a water supply system communicating from the toilet's pressurized water supply system and a water waste system communicating to the bowl of a toilet being serviced.

The paper wetting device is a vertically elongate, five sided box-like structure with its front substantially open. The top of the device is pivotably mounted to act as a lever to control a water input valve and defines a secondary reservoir to disperse contained water by gravity action in a vertical sheet over a timed period. The lower portion of the wetting device provides a container to collect any unused water and channel it to a water waste system. The open portion of the front of the wetting device allows a user to manually maintain toilet tissue in the vertical water fall to wet that tissue prior to use.

The water supply system comprises a conduit communicating from the pressurized water supplyproviding water to the water closet to a normally closed valve that may be operated by pivotable motion of the wetting device top to allow passage of water to the secondary reservoir carried by the top. The water waste system comprises a drain in the bottom of the wetting device communicating by conduit to the bowl of a serviced toilet, wherein any water may be wasted.

In providing such a device it is:

A principle object of my invention is to create a device which allows the wetting of toilet paper prior to use.

A further object of my invention to provide such a device that disperses a quantity of water to a secondary disbursal reservoir which disburses that water by gravity in a sheet-like manner and over a period of time for effective wetting of toilet paper.

A further object of my invention to create such a device that is carried by the water closet of a toilet and may be used with toilet systems of present day commerce without any substantial changes or modifications.

A still further object of my invention to provide such a device that is completely self-contained and may be operated readily by one hand of a user.

A still further object of my invention to provide such a device that is of new and novel design, of rugged and durable nature, of simple and economic manufacture and one otherwise well suited to the uses and purposes for which it is intended.

Other and further objects of my invention will appear from the following specification and accompanying drawings which form a part hereof. In carrying out the objects of my invention, however, it is to be understood that its essential features are susceptible to change in design and structural arrangement with only one preferred and practical embodiment being illustrated in the accompanying drawings as is required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

Figure 1:
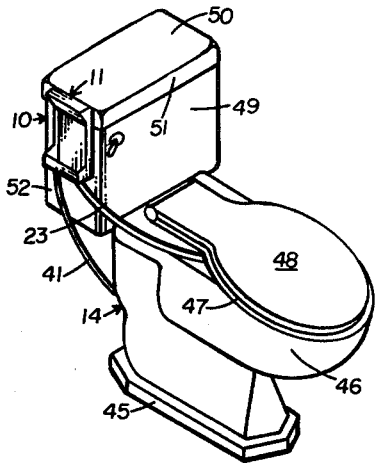
FIG. 1 is an isometric view of an ordinary toilet stool and water closet of modern day commerce showing my invention in operative position thereon.
Figure 2:
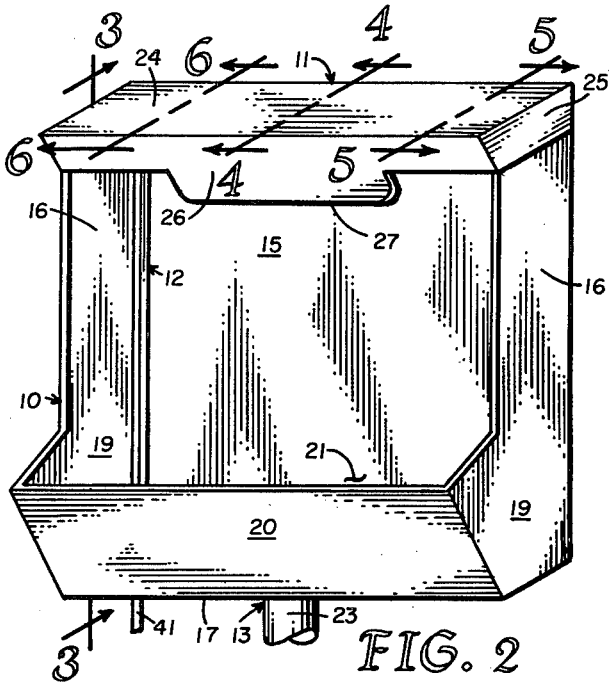
FIG. 2 is an isometric surface view of the front of my invention showing its various parts, their configuration and relationship.
Figure 3:
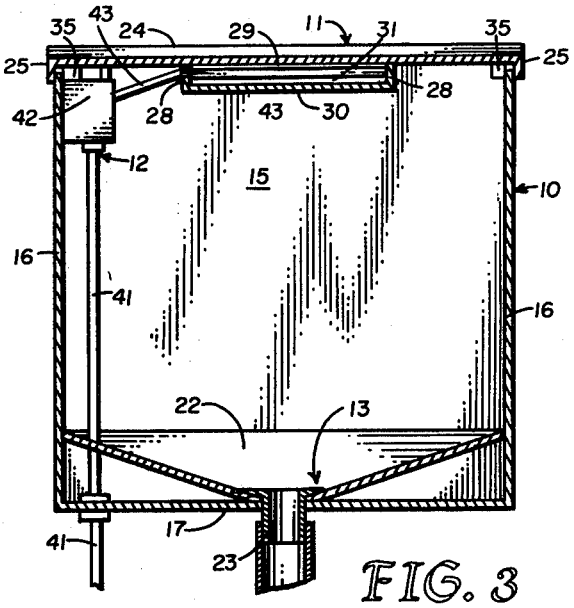
FIG. 3 is a vertical, traverse cross-sectional view of the device of FIG. 2 taken on the line 3—3 thereon, in the direction indicated by the arrows.

My invention generally provides a toilet paper wetting device with body 10 and pivotably mounted top 11 serviced by water supply system 12 and water exhaust system 13, all associated with and carried by common flush type toilet system 14.

Body 10 of the wetting device is a box-like structure formed by planar sheet-like back 15, similar sides 16, and bottom 17, all mechanically interconnected at adjacent peripheral edges as illustrated in FIG. 1. The upper edges of sides 16 are angled slightly in a forward and downward direction to allow top 11 to fit thereover with a slightly downwardly angled rake. The lower portions 19 of the sides extend forwardly beyond the forward extension of the upper portion and structurally carry lower front panel 20 therebetween to form a somewhat enlarged lower basin 21 to aid in catching any water that may be presented thereto from the secondary water reservoir associated with top 11.

Water exhaust system 15 comprises drain pan 22 carried within lower basin 21 and extending from structural communication with the internal periphery of that basin inwardly and downwardly to communicate structurally and in a water tight fashion with drain pipe fixture 23 which communicates through drain pan 22 and bottom 17 to carry flexible drain pipe 23 about its periphery. Drain pipe 23 is of sufficient length to extend into the bowl defined within an associated toilet stool.

Top member 11 is formed by planar top element 24, similar opposed vertically depending side elements 25 and angularly depending front element 26 all structurally joined at their adjacent peripheral edges. The top is so configured and dimensioned that it covers the uppermost portion of body 10 with side elements 25 extending downwardly over the outside of the upper portion of body side elements 16 with sufficient clearance to allow slight pivotable motion of the top member relative to the body. Front element 26 of the top member defines rearwardly and downwardly depending water disbursing element 27 which aids in causing water to flow therefrom in an elongate sheet.

The medial portion of the top member carries the secondary water reservoir formed on the undersurface of top element 24 by similar sides 28, back 29, and bottom 30, all communicating with each other and with top and front elements 24, 26 as illustrated with adjacent peripheral edges structurally joined to define reservoir chamber 31. Reservoir bottom 30, when operatively positioned, preferably slopes very slightly downwardly and forwardly to allow gravity drainage of water from the reservoir. The width of the reservoir, that is its extension in a direction between sides of the body, is preferably substantially the same as the width of water disbursing element 27 and the reservoir is positioned immediately rearwardly of that water dispersing element. A plurality of holes 32 defined in spaced array in the forward portion of bottom 30 of the reservoir allow water to pass by action of gravity onto the upper angled surface of the water dispersing element for subsequent travel thereover and ultimate dispersement from the rearward edge thereof.

Figure 5:
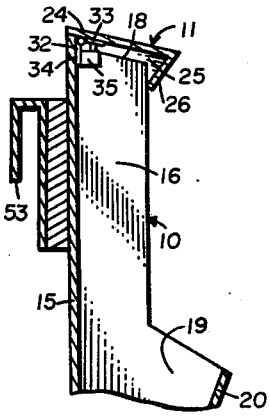
FIg. 5 is a vertical, cross-sectional view through one end portion of the device of FIG. 2 taken on the line 5—5 thereon, in the direction indicated by the arrows.
Figure 6:
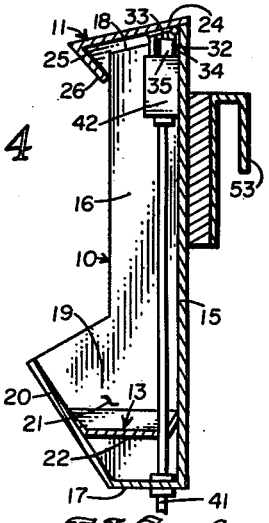
FIG. 6 is a vertical, cross-sectional view through the valve end of the device of FIG. 2 taken on the line 6—6 thereon, in the direction indicated by the arrows.

Top element 24 is mounted on body 10 for pivotable motion by piano hinge 32, upper flange 33 of which communicates with the rearward under surface of top element 24 and the lower flange of which communicates with the uppermost part of the inner surface of body back 15, as illustrated particularly in FIGS. 5 and 6.

Figure 7:
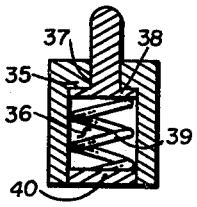
FIG. 7 is a somewhat enlarged medial, cross-sectional view through one of the lid biasing devices to show its internal structure.
Figure 8:
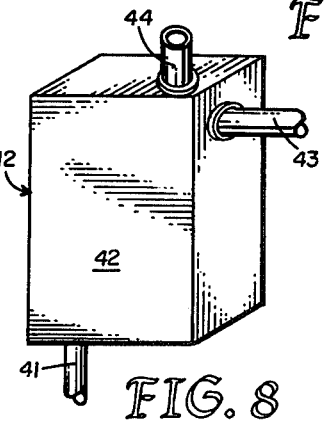
FIG. 8 is a somewhat enlarged isometric, surface view of the input valve of my device.

The angled position of top member 11 is maintained at a spaced distance above the body and biased against further pivotably downward motion by similar opposed spring biasing devices shown particularly in FIG. 7. Each of these devices provides body 35 defining larger medial spring cavity 36 communicating at one end with smaller biasing piston rod hole 37 which extends through the other end. Biasing piston 38 having a piston cylinder to slidably fit within spring chamber 36 and a rod to slidably fit within rod hole 37 is carried in the body as shown, with compression spring 39 in the spring chamber behind the biasing piston and the end of the piston rod extending from the body. Cap 40 is pressed to fit into the end of the spring chamber to be there maintained to close the chamber. With this structure biasing piston 38 may be moved in body 36 against the bias of spring 39 but otherwise will maintain the normal relaxed position illustrated in FIG. 7 with full extension of the piston rod. Two of these biasing devices are positioned, one on each side 16 of the body, in such position as to be in relaxed condition when top member 11 is positioned as illustrated especially in FIGS. 4, 5 or 6 with some slight forward and downward slope of top element 24. These biasing devices will maintain the top member in this relaxed position against gravity force but will allow its slight downward pivotable motion against the bias of spring 39 upon manual manipulation so that the top may be used as an activator for the input valve of the water system of the wetting device. The biasing devices are mechanically fastened in appropriate position on the body, preferably by welding or adhesion depending upon the material from which my wetting device is formed.

Water system 12 includes pipe 41 extending from the pressurized water supply (not shown) of a toilet water closet through bottom 17 of body 10 and upwardly to dispersement valve 42. Supply pipe 43 communicates from the distribution valve and preferably through chamber 31 of the water reservoir. The portion of supply pipe 43 within the chamber of the water reservoir defines plural spaced holes to discharge water uniformly in the reservoir. Dispersement valve 42 is a normally closed valve operative responsive to vertical motion of valve lever 34 to disperse water to chamber 31 of the secondary water reservoir. The quantity of water dispersed is proportional to the time and manner of depressions of the valve lever. Such a valve is well known in the plumbing arts, constitutes no novel part of my invention per se and therefore is not shown in detail. The valve is positionally maintained on side 16*a* in its upper part as illustrated so that valve lever 44 will rest against the under-surface of top element 24 when the element is in a normally relaxed position. The valve lever may be activated by slight manual depression of the top element against its spring bias. The valve is positionally maintained on side 16*a* by appropriate mechanical means, preferably welding or adhesion depending upon the materials from which the joined elements are formed.

Having thusly described the structure of my invention its operation may be understood.

A typical modern toilet system 14 is illustrated in FIG. 1 of the drawings where the stool is seen to comprise base 45 supporting bowl structure 46 which in turn carries on its upper surface pivotably mounted seat 47 and cover 48 thereabove. Water closet 49 is supported immediately rearwardly and above the toilet stool to allow gravity flow of water into bowl structure 49. The water closet defines a five sided structure for containment of water that is closed in its upper part by removable top 50 positionally maintained by depending skirt 51 extending downwardly therefrom about the upper portion of the water closet.

Figure 4:
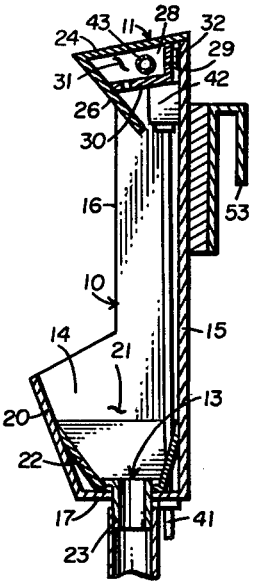
FIG. 4 is a medial, vertical, cross-sectional view of the device of FIG. 2, taken on the line 4—4 thereon, in the direction indicated by the arrows.

My invention is preferably maintained on side 52 of water closet 49 in a medial upper position. The positional maintenance may be accomplished by a thin metal "U" shaped bracket 53 as illustrated in FIGS. 4, 5 and 6 or by adhesion or other fastening means. If bracket 53 is used it will be carried over the upper edge of side 52 of the water closet and have appropriate offset to allow skirt 51 of top 50 to fit thereover in normal position.

To use my invention a wetting device is formed as specified and positioned on water closet 49 as stated. Drain pipe 23 is positioned to exhaust water into bowl structure 46 of the toilet stool, preferably by passing beneath the seat element through a space normally provided in the ordinary conventional toilet between the upper portion of the bowl suface and the seat. Water supply pipe 41 is interconnected with the pressurized water supply (not shown) servicing the toilet system so that water under normal household pressure will be presented to that pipe.

To operate the device, toilet paper is held in the hand of a user and maintained below water disbursing element 27 of front 26 of top member 11. While the paper is in this position the top member is slightly depressed against its spring bias, commonly by the same hand holding the toilet paper, so that valve lever 44 will be depressed to operate dispersement valve 42. When this valve is operated it will disburse water into reservoir chamber 31 at ordinary atmospheric pressure. The water will pass from this reservoir chamber by gravity through holes 32 and onto the upper surface of water dispersing element 27 from whence it will pass by gravity along that surface to ultimately flow from the rearward edge of that element downwardly and onto the piece of toilet paper being maintained therebelow to wet that paper prior to normal use in toilet functions.

The amount of water disbursed in one operation is regulated by appropriate manipulation of dispersement valve 42. The time of disbursement of water from reservoir chamber 31 may be regulated by adjustment of the size, number and spacing of holes 32 in the reservoir bottom. These various parameters may be appropriately determined to provide desired water dispersal under particular circumstances. Commonly it is preferable that approximately one ounce of water be dispersed over dispersal element 27 in a period of about five seconds after operation of dispersement valve 42.

It should be noted from the foregoing description that my paper wetting device is relatively small compared to the size of a toilet water closet and obviously may be variously positioned thereon. Commonly it will be more convenient on one side or the other of the water closet but it might also be positioned on the front. Various positioning might be desired for different uses and for uses by persons having differently oriented dexterities.

It should be further noted that if it is desired to use my device as a typical European bidet, a plug or stopper might be placed in the upper orifice of drain fixture 23 and water allowed to collect in drain pan 22 where it would remain available for use in washing so long as the drain fixture be plugged. It should further be noted in connection with this use that, if desired, a water warming device could be added or a warm water supply provided to furnish warm water.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. In a device to wet toilet paper prior to use, the combination, comprising:

a box-like body having an accessable opening wherein toilet paper to be wetted may be held, first means of dispersing water by gravity upon toilet paper maintained in said opening;

an associated water supply system communicating from a source of pressurized water through a normally closed manually operative dispersement valve to a secondary reservoir from whence water is dispersed to the first water disbursing means;

second means of manually operating the dispersement valve of the water supply system to pass a predetermined quantity of water; and a water exhaust system, below the opening in the body, to receive water disbursed by the first water dispersing means and pass that water, by gravity, through a conduit to an associated water waste system.

2. A device, associated with a flush toilet system, for wetting toilet paper comprising, in combination:

(1) a peripherally defined body positioned above an associated toilet stool and having an opening in its front wherein toilet paper to be wetted may be held, a top element, defining a secondary reservoir to receive a quantity of water and disperse that water by gravity and over a period of time, above the opening in the body front, and a lower basin below the opening in the body front to receive water dispersed from a secondary reservoir;

(2) a water supply system having a conduit communicating from the pressurized water supply of the associated toilet system to the secondary reservoir, a normally closed dispersement valve in said conduit to allow the passage of a predetermined quantity of water therethrough upon manual activation thereof, means for manually activating the dispersement valve; and (3) a water exhaust system having a conduit communicating from the basin defined in the lower portion of the body to an associated toilet stool.

3. The invention of claim 2 further characterized by:

the secondary reservoir dispersing water by gravity flow over a linear edge to provide a sheet-like vertical water flow and the top of the body comprising a separate element mounted for vertical pivotal motion against a mechanical bias and communicating with the dispersement valve to cause activation thereof.

4. A device for wetting toilet paper, prior to use, proximately associated with a toilet system having a stool and a water closet thereabove comprising, in combination:

(1) a vertically elongate box-like body, positioned vertically above the toilet stool, with an opening in the front having a width of at least that of a sheet of toilet paper to be wetted, and a pivotably mounted top positionally maintained against downward motion by mechanical biasing means, an upper front portion of the top angling downwardly and inwardly with a water disbursing element having a lineal edge vertically above the open front, a secondary reservoir immediately below the top element with means to disperse water to the upper surface of the water dispersing element, and a lower basin below the dispersement element to receive water therefrom;

(2) a water supply system comprising a conduit communicating from a pressurized water supply servicing the associated toilet system through a normally closed dispersement valve to the secondary reservoir, said dispersement valve being operated responsive to manual downward motion of the top member of the body structure against its bias and dispersing a predetermined quantity of water to the secondary reservoir upon operation; and (3) a water exhaust system comprising a drain in the lower basin of the body structure communicating with a conduit communicating in turn to the bowl of an associated toilet stool.

* * * * *